US007922564B2

(12) United States Patent
Gilles

(10) Patent No.: US 7,922,564 B2
(45) Date of Patent: Apr. 12, 2011

(54) SANDING ELEMENT

(75) Inventor: Dominique Gilles, Tildonk (BE)

(73) Assignee: Cibo N.V. (BE)

( * ) Notice: Subject to any disclaimer, the term of this patent is extended or adjusted under 35 U.S.C. 154(b) by 0 days.

(21) Appl. No.: 12/749,506

(22) Filed: Mar. 29, 2010

(65) Prior Publication Data

US 2010/0184358 A1 Jul. 22, 2010

Related U.S. Application Data

(62) Division of application No. 10/578,256, filed as application No. PCT/IB2005/050799 on Mar. 3, 2005, now Pat. No. 7,727,056.

(30) Foreign Application Priority Data

Mar. 3, 2004 (BE) ..... 2004/0116

(51) Int. Cl.
*B24B 1/00* (2006.01)

(52) U.S. Cl. ..... 451/57; 451/59

(58) Field of Classification Search ..... 451/464, 451/465, 466, 496, 497, 498, 526, 527, 530, 451/532, 533, 537, 28, 57, 59, 63, 65, 66, 451/259

See application file for complete search history.

(56) References Cited

U.S. PATENT DOCUMENTS

| | | | |
|---|---|---|---|
| 2,958,593 | A | 11/1960 | Hoover |
| 3,529,385 | A | 9/1970 | Stein |
| 3,706,167 | A | 12/1972 | Schaffner |
| 4,078,340 | A | 3/1978 | Klecker et al. |
| 4,275,529 | A | 6/1981 | Teetzel et al. |
| 4,659,609 | A | 4/1987 | Lamers et al. |
| 4,715,150 | A | 12/1987 | Takeuchi |
| 4,872,292 | A | 10/1989 | Block |
| 4,991,362 | A | 2/1991 | Heyer et al. |
| 5,025,596 | A | 6/1991 | Heyer et al. |
| 5,082,720 | A | 1/1992 | Hayes |
| 5,752,876 | A | 5/1998 | Hettes |
| 5,863,305 | A | 1/1999 | Beardsley et al. |
| 6,251,002 | B1 | 6/2001 | Close |
| 6,582,289 | B1 | 6/2003 | Eisenberg |
| 2002/0037694 | A1 | 3/2002 | Katsuyama et al. |
| 2006/0160480 | A1 | 7/2006 | Keuler |

FOREIGN PATENT DOCUMENTS

| | | | |
|---|---|---|---|
| EP | 1093885 | A1 | 4/2001 |
| EP | 1684945 | B1 | 8/2007 |
| RU | 2357850 | C2 | 6/2009 |

OTHER PUBLICATIONS

Network Solutions, LLC, "Registry Data: lehighvalleyabrasives.com." 1 (creation date 2007). *Available at* <http://www.networksolutions.com/whois/registry-data.jsp?domain=lehighvalleyabrasives.com> as of Jan. 13, 2010.

LeHigh Valley Abrasives, "Home > Interleaf > 4-½' Interleaf Quick Combination Flap Disc." 1-2. Available at <http://www.lehighvalleyabrasives.com> as of Jan. 13, 2010.

Cibo, RCD. 1-4. Available at <http://www.cibo-abrasives.com/photos/downloads/PDF/RCD_A4_ENG.pdf> as of Jan. 13, 2010.

*Primary Examiner* — Eileen P Morgan

(74) *Attorney, Agent, or Firm* — Aexius, LLC; Michael A. Long, Esq.

(57) ABSTRACT

The invention concerns a sanding element with a succession of overlapping lamellas (3, 4) comprising sanding grains (9), characterized in that these lamellas (3, 4) are alternately formed of sanding lamellas (3) and compressible lamellas (4), whereby each sanding lamella (3) rests on a compressible lamella (4).

1 Claim, 1 Drawing Sheet

SANDING ELEMENT

CROSS-REFERENCE TO RELATED APPLICATIONS

This application is a divisional of Ser. No. 10/578,256 filed on May 4, 2006, which is a national stage application of PCT/IB2005/050799 (WO2005/087436) filed on Mar. 3, 2005, which claims the benefit of application no. 2004/0116 filed in Belgium on Mar. 3, 2004.

BACKGROUND OF THE INVENTION

1. Field of the Invention

The present invention concerns a sanding element with a succession of overlapping lamellas containing sanding grains.

Such sanding elements are made in the form of what is called a laminated disc, whereby successive lamellas are arranged according to the peripheral direction of the disc and overlap. These sanding elements are used for example for sanding and finishing, more particularly for polishing welds on metal workpieces.

2. Description of Related Art

American U.S. Pat. No. 6,582,289 describes a laminated disc with a succession of overlapping lamellas. These lamellas are alternately formed of abrasive cloth containing sanding grains and lamellas provided with an active sanding layer. Such an active sanding layer contains no sanding grains, provides mainly for the removal of removed material and reduces the heating of the workpiece to be sanded.

However, the existing sanding elements are disadvantageous in that they get into a relatively hard contact with the surface of a workpiece to be treated, such that it is difficult to exert a constant pressure between the workpiece and the sanding element. Moreover, the existing sanding elements have a relatively short life and, after a metal surface has been sanded with such an aggressive sanding element, this surface must be further treated with what is called a finishing disc in order to obtain a smooth and aesthetically acceptable surface.

SUMMARY OF THE INVENTION

The invention aims to remedy these disadvantages by providing a sanding element with a much longer life than the present sanding elements, while it allows for finishing a workpiece almost to perfection in a very fast manner, as a result of which the use of two different discs is no longer necessary. The sanding element according to the invention makes it possible to remove material from the workpiece as well as to perfectly finish the workpiece, both with from an aesthetic and a technical point of view. More particularly, with the sanding element according to the invention, very low roughness values up to 3 Ra/cm$^2$ of the surface of a workpiece can be obtained in a single step.

To this aim, said lamellas are alternately formed of sanding lamellas and compressible lamellas, such that every sanding lamella rests on a compressible lamella.

Practically, these compressible lamellas are elastically compressible.

In an advantageous manner, said compressible lamellas contain non-woven fibres, more particularly non-woven synthetic fibres.

According to a preferred embodiment of the sanding element according to the invention, sanding grains are provided on said fibres.

According to an interesting embodiment of the sanding element according to the invention, said fibres are joined together by means of gluing, for example by means of a synthetic resin, and thus have a three-dimensional open fibre structure.

Preferably, said lamellas are fixed on a round, disc-shaped support, whereby the free edges of these lamellas extend practically radially, such that the sanding element forms what is called a laminated disc.

Other particularities and advantages of the sanding element according to the invention will become clear from the following description of a few special embodiments of the invention; this description is given as an example only and does not restrict the scope of the claimed protection in any way; the figures of reference used hereafter refer to the accompanying drawings.

DETAILED DESCRIPTION OF THE DRAWINGS

In the different drawings, identical figures of reference refer to the same elements.

The invention generally concerns a sanding element, more particularly a laminated disc, which contains successive overlapping lamellas. These lamellas are alternately formed of sanding lamellas, whose outer surface or free surface is provided with sanding grains, and compressible lamellas upon which the sanding lamellas rest.

Figure 1:
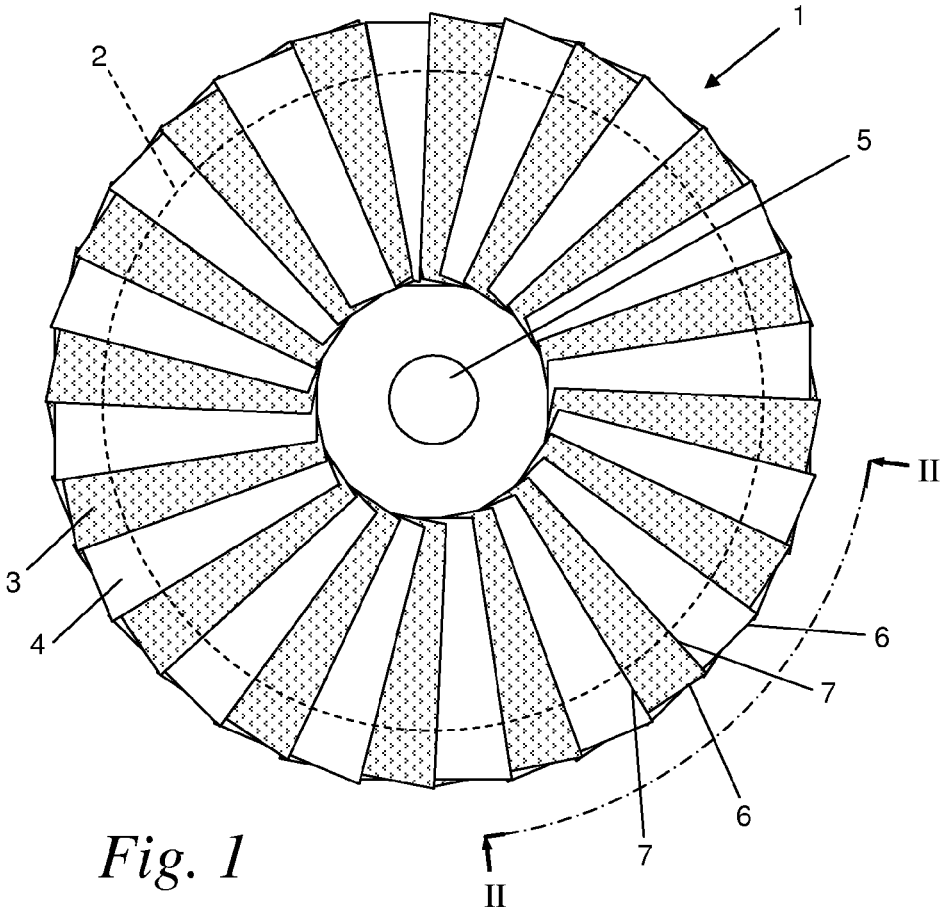
FIG. 1 is a schematic view from above of the sanding element according to the invention.
Figure 2:
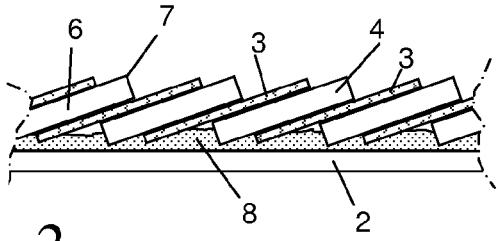
FIG. 2 is a schematic side-view according to line II-II of the sanding element from FIG. 1.

FIG. 1 represents such a sanding element in the form of a laminated disc 1. The latter contains an almost non-deformable round, disc-shaped support 2 on which a sanding lamella 3 and compressible lamella 4 are alternately fixed, in such a manner that each lamella 4 overlaps with a sanding lamella 3. The sanding lamella 3 here each time rests with its operational part on a corresponding compressible lamella 4.

Said support 2 has a central opening 5 via which the laminated disc 1 can be mounted on a drive in a manner known as such. This drive, which is not represented in the figures, makes it possible to rotate the laminated disc 1 at high speed around its axis, whereas the disc 1 is pressed against the workpiece, such that the lamellas 3 and 4 make contact with the surface of said workpiece to be finished.

The disc according to the invention hereby makes an even contact with the surface of the workpiece with an almost uniform pressure, thanks to the compressibility of the lamellas 4.

The sanding lamellas 3 are formed for example of a cotton or polyester textile fabric onto which are fixed sanding grains by means of a bonding layer. Thus such lamellas are formed for example of abrasive cloth. However, these lamellas may also be formed of a paper, a polyester or a mixed support such as polyester cotton onto which are provided sanding grains.

The compressible lamellas 4 mainly consist of fibres 10. More particularly, these compressible lamellas 4 are formed of non-woven synthetic fibres 10 which are joined together by means of a synthetic resin and thus have a three-dimensional open fibre structure. This fibre structure is glued onto a woven base 11, or adhered thereto in another manner.

Further, sanding grains 9 are provided on the fibres 10 via this synthetic resin. In order to make sure that, when using the laminated disc 1, the fibres 10 will stick to each other, irrespective of the heat that is produced while sanding, a thermosetting synthetic resin is preferably used as said synthetic resin. The synthetic fibres 10 are formed for example of polyamide yarns having a diameter between 0.75 and 0.85 mm.

Figure 3:
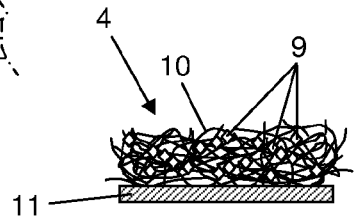
FIG. 3 is a schematic cross-section to a larger scale of a compressible lamella according to the invention, represented in greater detail.

Thus, these compressible lamellas 4 form an open three-dimensional structure which is elastically deformable. The fibres 10 extend in this structure in an almost disorderly manner. FIG. 3 represents a cross-section of such a compressible lamella 4.

As the lamellas 3 and 4 overlap, each sanding lamella 3 is at least partly supported by a compressible lamella 4. When the laminated disc 1 thus makes contact with the surface of the workpiece of a workpiece to be finished, a practically homogenous pressure will be exerted in the contact surface between said workpiece and the laminated workpiece 1, as already mentioned above.

In order to make sure that a relatively soft contact is made between the surface of the workpiece and the laminated disc 1, the thickness of the compressible lamellas 4 is preferably at least equal to three times the thickness of said sanding lamellas 3.

According to an interesting embodiment of the sanding element according to the invention, the thickness of the sanding lamellas 3 is almost 0.5 mm to 1 mm, whereas the thickness of the compressible lamellas 4 is for example in the order of magnitude of 3 to 8 mm. Every lamella 3 and 4 forms a rectangle with a short side 6 having a length of almost 20 mm and a long side 7 of some 30 mm. The long side 7 of the top side of the lamellas 3 and 4, or in other words the free edge thereof, extends practically radially onto the support 2, whereas the short side 6 is situated in a tangent plane on the circumference of the lamellas.

The lamellas 3 and 4 overlap in the direction of their short side 6, over a distance which is practically equal to ⅔ to ⅚ of the length of this short side 6. The lamellas 3 and 4 preferably overlap over a distance of ¾ of the length of short side 6.

The lamellas 3 and 4 are fixed tightly to said support by means of a layer of glue 8.

The laminated disc 1 according to the invention is particularly interesting when it is used to remove a surface layer on metal surfaces.

Figure 4:
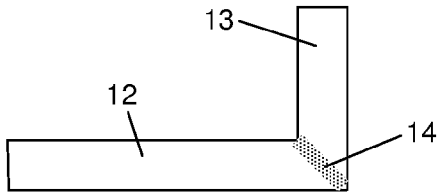
FIG. 4 schematically represents a view from above of two pipes which are welded together at an angle of 90°.

FIG. 4 schematically represents a workpiece consisting of two pipes 12 and 13 made of stainless steel with a diameter of 40 mm which are welded together at right angles. The formed weld 14 extends at an angle of 45° in relation to the axis of the pipes 12 and 13.

According to the state of the art, after sanding with a conventional aggressive sanding instrument such as a fibre disc, a lamella sanding disc, a trimming disc, etc., such a weld 14 of a workpiece is smoothened by a means of what is called a conventional finishing disc, which mainly has a three-dimensional open fibre structure in which are provided sanding grains.

In some cases, it is possible to sand and finish the workpiece in a single step with one and the same finishing disc. In that case, the finishing disc will be entirely worn after smoothening the surface of five workpieces. When the same finishing process is carried out by means of the laminated disc 1 according to the invention, it is found that one and the same disc can treat sixteen of such workpieces before the disc has work out.

Moreover, it was found that in order to smooth 25 welded joints by means of said conventional finishing disc, a processing time of 41 minutes and 36 seconds was required. When 25 identical welded joints are smoothened by means of the laminated disc according to the invention, only 23 minutes and 52 seconds are required.

Thus, on the bases of these tests it was found that, with the laminated disc according to the invention, one can work almost twice as fast as with a conventional finishing disc. Further it turned out that the life of the laminated disc according to the invention is more than three times the life of a conventional finishing disc.

The sanding lamellas and the compressible lamellas may contain all sorts of sanding grains, such as for example ceramic sanding grains or aluminum oxide grains, zirconium oxide grains, silicon carbide or an agglomerate of these grains. Very good results were obtained with what are called structured sanding grains which are described for example in European patent EP 1 011 924 and which are provided for example according to a regular pattern and with a specific orientation on the lamellas of the sanding element. Such structured grains are formed for example of conventional sanding grains whose surface is coated with what are called functional powders, such as very fine sanding grains, antistatic additives, lubricants, etc.

Further, the sanding lamellas 3 and/or the compressible lamellas 4 may be composed of several lamellas of the same type. Thus, it is also possible that the sanding element contains a succession of overlapping groups of lamellas, whereby these groups are alternately formed of at least one sanding lamella 3 and at least one compressible lamella 4. Each group of sanding lamellas 3 hereby rests on a group of compressible lamellas 4. This implies among others that a group of sanding lamellas containing for example two of more sanding lamellas 3 can rest on only one compressible lamella 4 or that for example each sanding lamella 3 can rest on a group of compressible lamellas 4. The lamellas of each group of lamellas preferably overlap.

Naturally, the invention is not restricted to the above-described embodiment of the sanding element according to the invention. Thus, for example the lamellas 3 and 4 must not necessarily be fixed onto a disc-shaped support, but they can also be fixed for example onto a closed belt.

The sanding element according to the invention cannot only be applied to finish welded joints made of stainless steel, but it can also be used to improve the surface roughness in general of any material whatsoever, such as for example, iron alloys, ferrous and non-ferrous alloys, stone, plastics, etc.

What is claimed is:

1. A method for finishing and removal of a workpiece with a single disc, comprising:

(a) rotating a succession of overlapping lamellas (3, 4) comprising sanding grains (9), characterized in that the lamellas (3, 4) are alternately formed of sanding lamellas (3) and compressible lamellas (4), said compressible lamellas (4) comprise non-woven fibres (10), each sanding lamella (3) rests on a compressible lamella (4), and the sanding lamellas (3) and the compressible lamellas (4) are fixed on a substantially round, disc-shaped support (2) where each lamella (3,4) comprises an exposed surface angled radially from the support (2), wherein each of the exposed surfaces of the lamellas (3,4) extend beyond the support and are formed by a short side (6) and a long side (7) of each lamella (3,4);

(b) removing material by sanding with the succession of overlapping lamellas (3, 4) as the lamellas (3, 4) are pressed against the support (2); and (c) simultaneously finishing without using a second sanding element.

* * * * *